United States Patent [19]

Kornfeld

[11] 4,177,893

[45] Dec. 11, 1979

[54] MERCHANDISE CONTAINER

[76] Inventor: William F. Kornfeld, 34 Shepherd La., Roslyn Heights, N.Y. 11577

[21] Appl. No.: 964,114

[22] Filed: Nov. 27, 1978

[51] Int. Cl.[2] ..... B65D 5/50

[52] U.S. Cl. ..... 206/45.14; 206/45.19; 206/486; 206/585; 220/8; 229/23 R

[58] Field of Search ..... 206/45.14, 45.19, 486, 206/488–489, 521, 562–563, 565, 585, 588, 590, 593–594; 229/23 R; 220/410, 8

[56] References Cited

U.S. PATENT DOCUMENTS

| | | | |
|---|---|---|---|
| 2,240,645 | 5/1941 | Greig | 206/45.19 |
| 2,553,418 | 5/1951 | Loth | 206/521 |
| 3,253,703 | 5/1966 | Ettin | 206/45.14 |
| 3,744,701 | 7/1973 | Taylor | 229/23 R |
| 3,941,305 | 3/1976 | Chipp et al. | 229/23 R X |

*Primary Examiner*—Steven E. Lipman
*Attorney, Agent, or Firm*—Alan H. Levine

[57] ABSTRACT

A merchandise container including a box-like base having an opening in its top wall. A box-like insert within the base projects through the opening above the base top wall, the top wall of the insert having an opening for accommodating an article of merchandise. A double walled shell has a liner within it, the liner projecting below the bottom edge of the shell and fitting snugly around the portion of the insert projecting above the base. A core is located between all the double walls of the shell to maintain a spacing between them. The container is formed of no more than five pieces of folded and glued paperboard, namely, the pieces forming the base, the insert, the shell, the liner, and the core. The insert includes a platform upon which the merchandise rests, and locking means for preventing removal of the insert from the base. Both ends of the shell may be open, the upper end being closed by the top wall of the liner. The liner may have a cross wall with an opening for accommodating the article of merchandise to stabilize the latter.

8 Claims, 11 Drawing Figures

FIG. 1
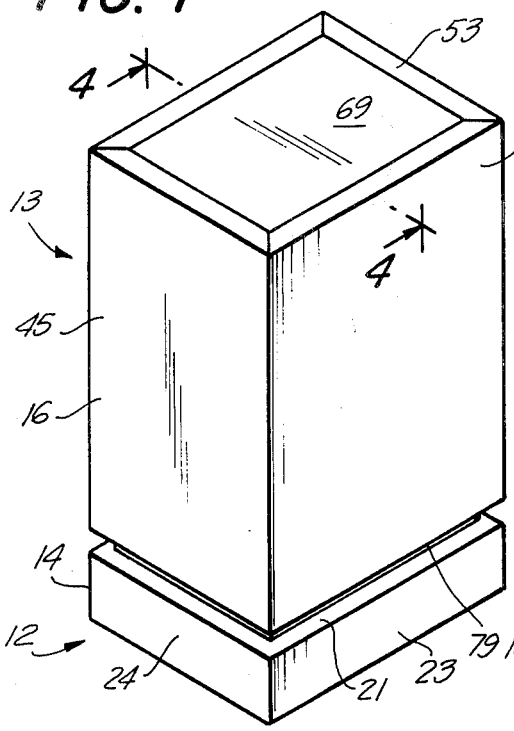
FIG. 2
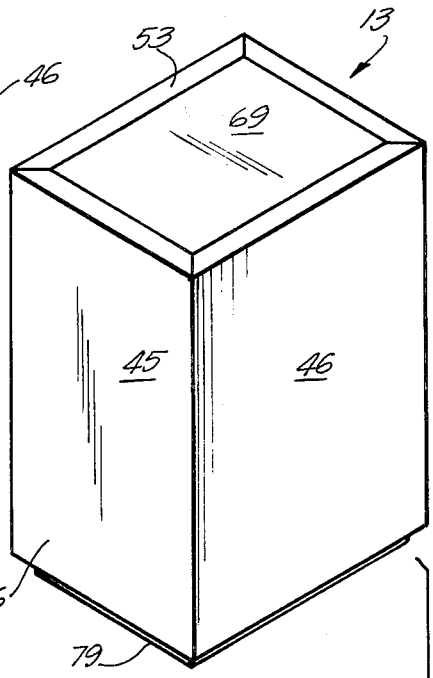
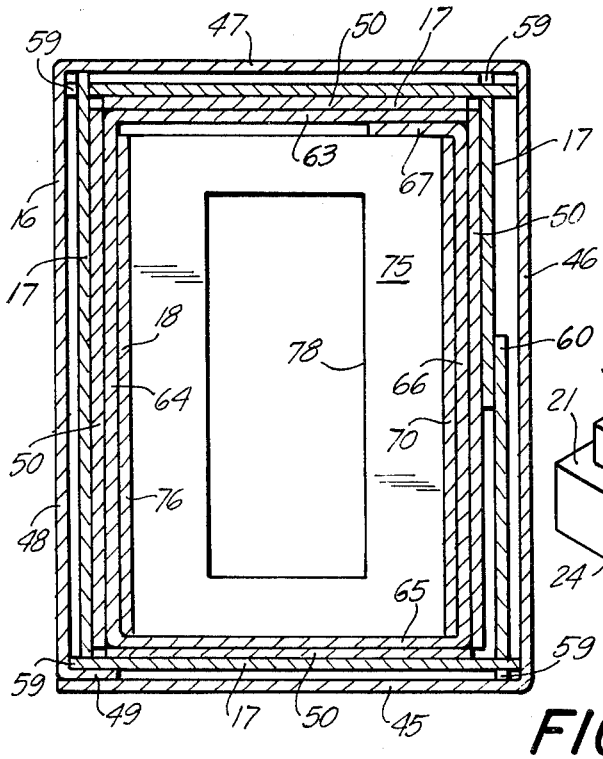
FIG. 6

FIG. 7
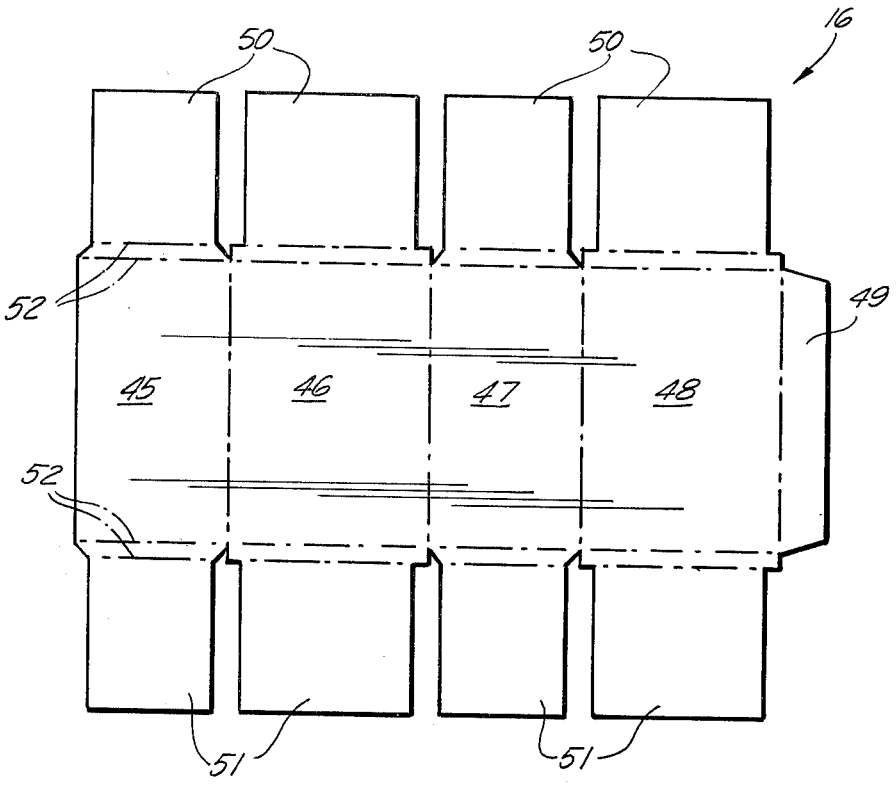
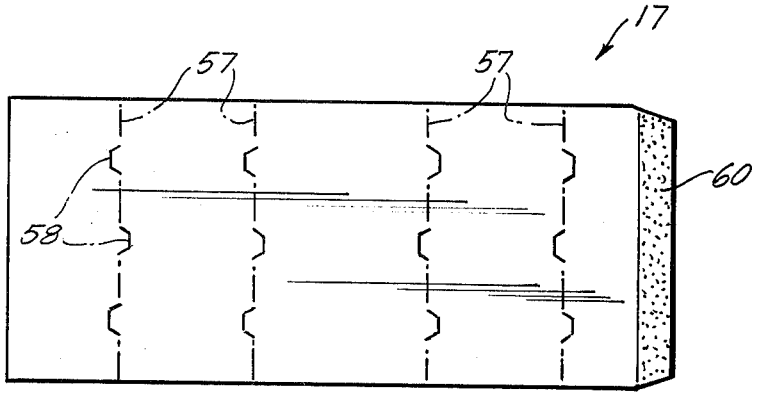
FIG. 8

MERCHANDISE CONTAINER

This invention relates to paperboard merchandise containers, and more particularly to such a container having a luxurious appearance for packaging a relatively expensive product, such as perfume.

Merchandise containers of the type to which the present invention relates are generally significantly larger than the product packaged in them, the greater volume of the package combined with the design of the container enhancing the costly image of the product. However, as the cost of packaging materials has risen, along with the cost of labor for assembling such materials into finished containers, many luxury containers have become too expensive to use commercially.

Therefore, it is an object of the present invention to provide a container for expensive luxury items having the same type of high quality appearance expected for packaging such items, but made of many fewer parts than comparable containers of the past and present.

It is another object of the invention to provide such a container the parts of which can be fabricated readily by machine, and which can be economically assembled by hand to produce the final container.

Additional objects and features of the invention will be apparent from the following description in which reference is made to the accompanying drawings.

In the drawings:

FIG. 1 is a perspective view of a closed container according to the present invention;

FIG. 2 is a perspective view of the container when opened;

FIG. 6 is a horizontal cross-sectional view taken along line 6—6 of FIG. 4; and

FIGS. 7–11 are pattern views of the five components of the container, namely, the shell, the core, the liner, the insert, and the base, respectively.

Figure 3:
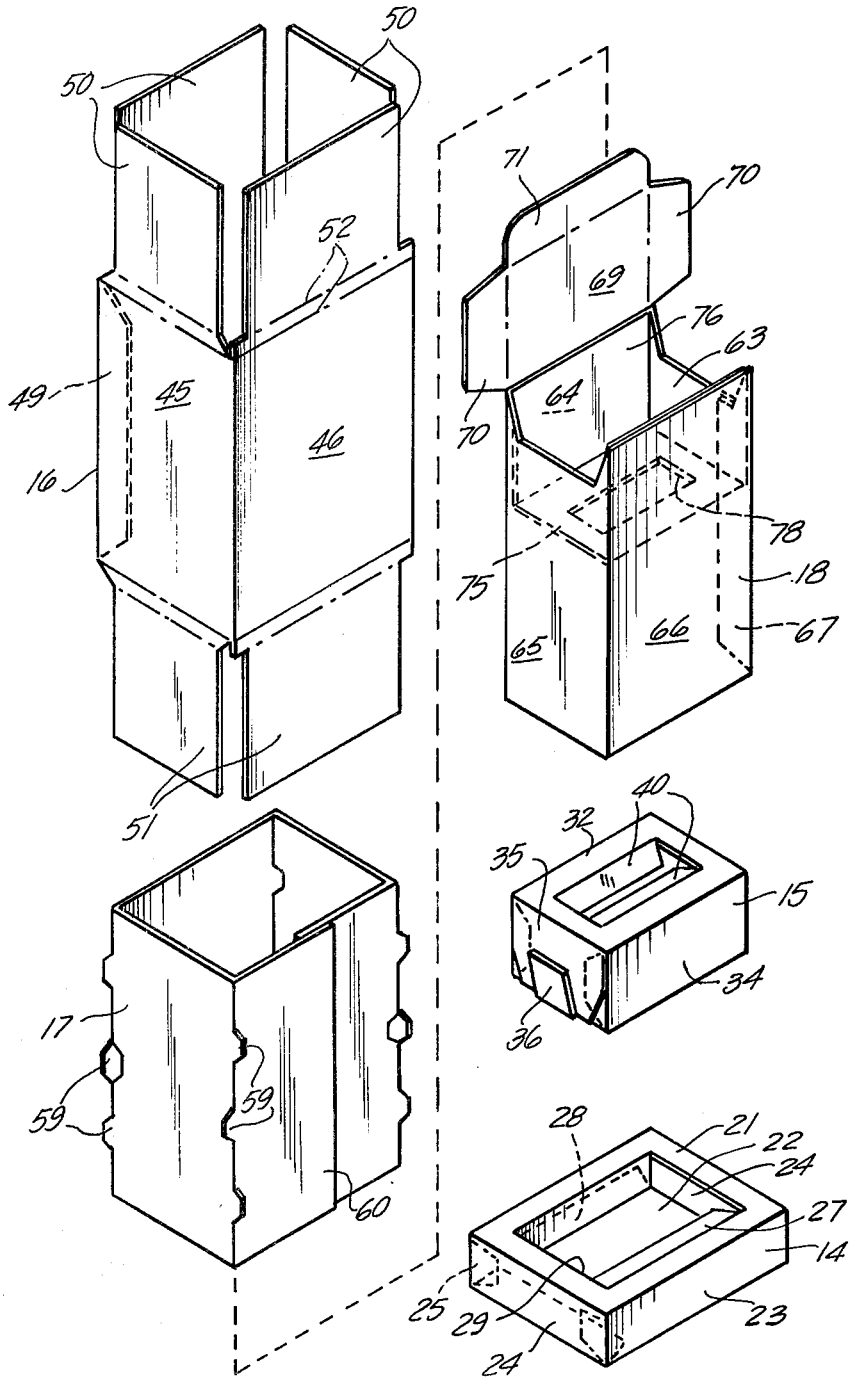
FIG. 3 is an exploded perspective view showing all the container components.

The merchandise container chosen to illustrate the present invention comprises, generally, a bottom part 12 and a cover 13 (FIGS. 1 and 2). Bottom part 12 includes two components, namely, a base 14 and an insert 15 (see also FIGS. 3–5). Cover 13 includes three components, namely, a shell 16, a core 17, and a liner 18 (see also FIG. 6).

Figure 11:
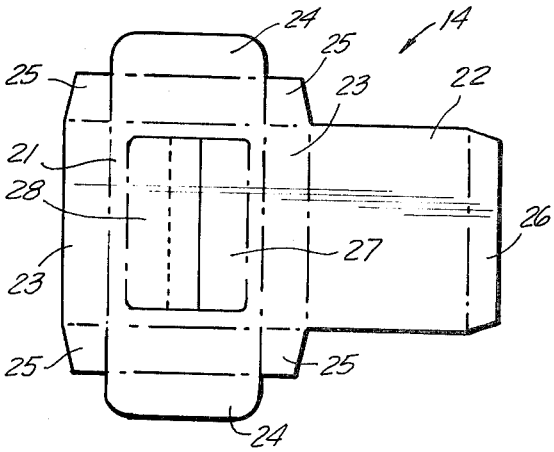

Base 14 is a box-like element formed of a single piece of folded and glued paperboard. The base has a top wall 21 (FIGS. 1–5 and 11), a bottom wall 22, two side walls 23, and two end flaps 24 folded into the base and held in place by the usual tucks 25. A glue flap 26 is adhesively secured to the inner face of the side wall 23 most remote from the glue flap in FIG. 11. Top wall 21 is furnished with slits and score lines defining two hinged panels 27 and 28. When these panels are pushed downwardly into the base, the larger panel 28 being folded back upon itself (see FIG. 4), an opening 29 is formed in the top wall 21 of base 14. Opening 29 accommodates insert 15.

Figure 10:
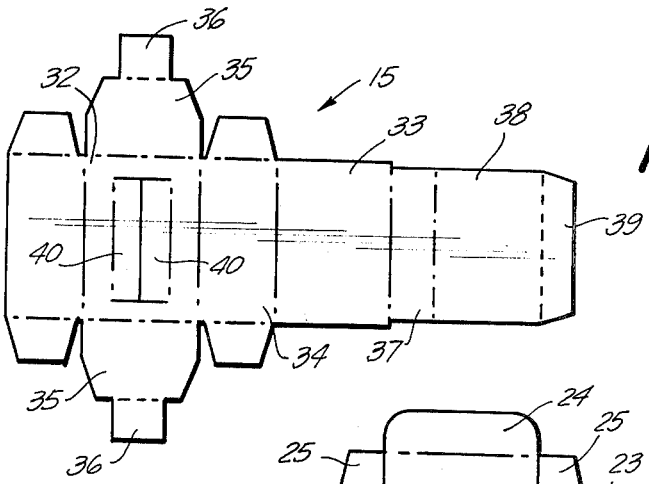

Insert 15 is a box-like element formed of a single piece of folded and glued paperboard. The insert has a top wall 32 (FIGS. 2–5 and 10), a bottom wall 33, two side walls 34, and two end flaps 35. A locking tab 36 projects from the end edge of each flap 35, and is joined to its respective flap along a score line. Connected to bottom wall 33, in series, are a panel 37, a platform 38, and a glue flap 39. Members 37, 38, and 39 are all folded in the same direction along the score lines between them, and glue flap 39 is adhesively secured to the inner face of side wall 34 (see FIG. 4) which is most remote from the glue flap in FIG. 10. As a result, platform 38 is arranged in a horizontal plane spaced above bottom wall 33.

Figure 4:
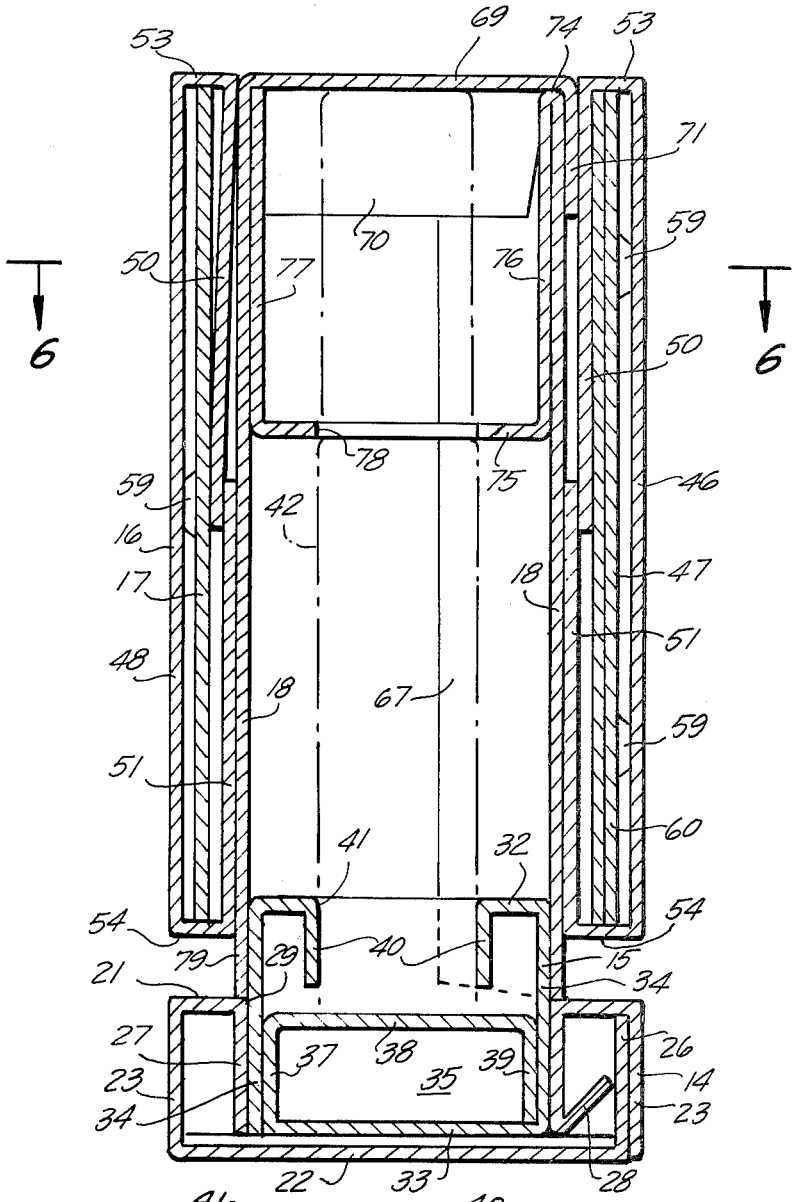
FIG. 4 is a vertical cross-sectional view taken along line 4—4 of FIG. 1.
Figure 5:
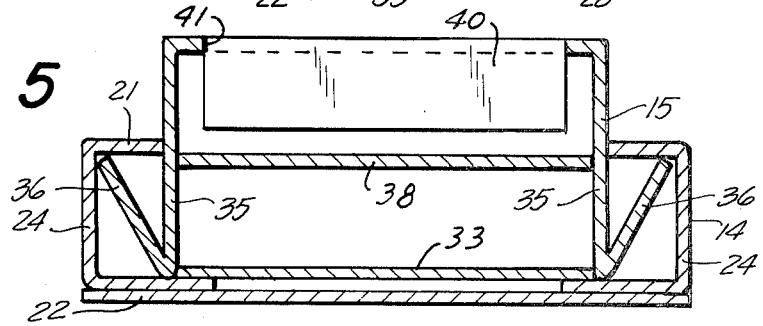
FIG. 5 is a vertical cross-sectional view through the bottom of the container in a plane at 90° to the view of FIG. 4.
Figure 9:
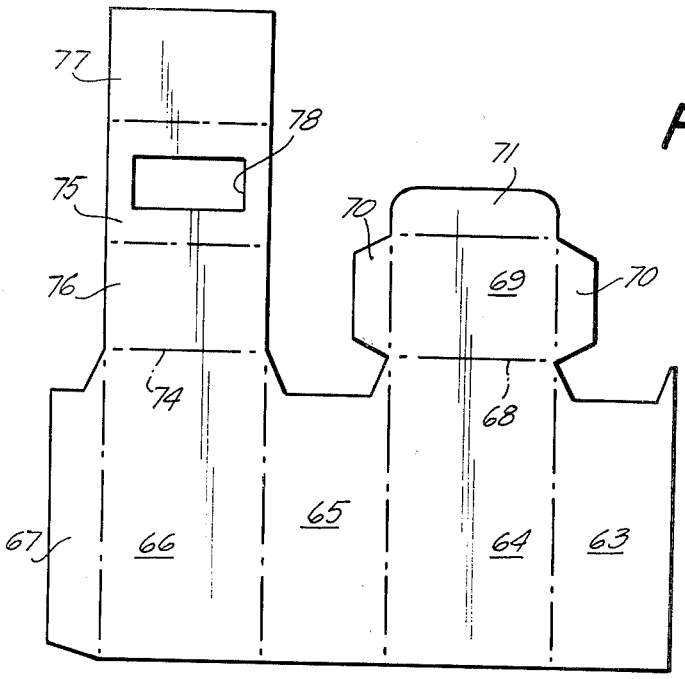

Just prior to introducing insert 15 into opening 29 in base 14, locking tabs 36 are folded upwardly against the outer faces of end flaps 35. Once inside base 14, tabs 36 spring outwardly, due to the inherent resilience of the paperboard, and the upper edges of the tabs engage the lower face of top wall 21 of base 14 (FIG. 5). As a result, insert 15 cannot be removed from the base. Since the side walls 34 and end flaps 35 have a vertical dimension greater than that of side walls 23 and end flaps 24, insert 15 projects above the top of base 14. On the other hand, the horizontal dimensions of insert 15 are smaller than the corresponding dimensions of base 14, thereby giving the assembled base and insert a stepped configuration, as shown in FIGS. 2, 4, and 5.

Top wall 32 of the insert is furnished with slits and score lines defining two hinged panels 40. When these panels are pushed downwardly into the insert, an opening 41 is formed in the top wall 32. Opening 41 accommodates the product 42 (FIGS. 2 and 4) being packaged, the bottom of the product resting upon platform 38 within insert 15.

Cover 13 includes a double walled shell 16 formed of a single piece of folded and glued paperboard. The shell includes four outer walls 45, 46, 47, and 48 joined along spaced parallel score lines. A glue flap 49 (FIGS. 3, 6, and 7) projecting from wall 48 is adhesively bonded to the inner surface of wall 45. Inner wall members 50 and 51 are connected to the upper and lower edges, respectively, of each outer wall 45–48. Between each inner wall member 50 and 51 and its respective outer wall is a pair of closely spaced apart and parallel score lines 52 (FIG. 7). Each inner wall member is folded into the shell defined by the outer walls 45–48 along the parallel score lines 52, until the inner wall members are generally parallel to their respective outer walls, the free ends of the inner wall members defining each inner wall being slightly overlapped. As a result, four double walls are created (e.g., double walls 48/50, 51; 46/50, 51, see FIG. 4), and narrow horizontal top and bottom walls 53 and 54, respectively (FIGS. 1, 2, and 4) are formed by the material between score lines 52. Thus, an open ended shell is produced having the appearance of being made of a much thicker material than is actually used to fabricate it.

Between each of the four double walls is a section of core 17. Core 17 is a sheet of cardboard or heavy paperboard divided into sections by vertical score lines 57 (FIG. 8). One end margin of core 17 defines a glue strip 60 which is adhesively bonded to the inner surface of the core section at the opposite end of the core sheet, so that when core 17 is folded at right angles along its score lines 57 a rectangular cross-section tube is formed (FIG. 3). Each score line is interrupted, in this example at three points, and a non-linear slit 58 is made in one of the core sections adjacent to each interruption. When core 17 is folded along score lines 57, the area within each slit does not fold with its respective core section but instead remains in its original plane as an outwardly projecting trapazoidal-shaped tab (FIGS. 3, 4, and 6).

Core 17 is inserted into shell 16 before inner wall members 50 and 51 are folded into the shell, i.e., when the shell is in the condition shown in FIG. 3. Inner wall members 50 and 51 are then folded around the end edges of the core so that each core section is located between the outer and inner walls of each side of the shell. The spacing between each pair of outer and inner walls is greater than the thickness of the core material, but the spacing is nevertheless maintained by the presence of tabs 59.

Within shell 16 is liner 18 formed of a single piece of folded and glued paperboard. The liner has a main portion formed of four sections 63, 64, 65, and 66 divided by parallel score lines. Projecting from one edge of section 66 is a glue flap 67 which is adhesively bonded to the inner surface of section 63 (FIG. 6). Joined to section 64 along a score line 68 is a panel folded over to form a top wall 69 of the liner (see FIGS. 1, 2, and 4). Hinged to the three free edges of top wall 69, along score lines, are three flaps 70 and 71. When liner 18 is inserted into shell 16, flaps 70 and 71 are folded at 90° to top wall 60 and tucked into the shell so that only smooth edges around the periphery of the top wall are seen. The top wall is placed in the same plane as top wall 53 of the shell so that top wall 69 of the liner closes the upper end of the shell.

Joined to section 66 of liner 18, along a score line 74, is a panel having two parallel score lines dividing the panel into a cross wall 75 between two support portions 76 and 77 (FIGS. 3, 4, 6, and 9). Before top wall is folded into position perpendicular to sections 63–66, the panel is folded through 180° along score line 74 into the liner, and the panel is also folded through 90° along the two score lines. As a result, cross wall 75 is located in a horizontal plane spaced downwardly from top wall 69, and is supported by the two vertically positioned portions 76 and 77. Cross wall 75 is formed with an opening 78 through which the upper portion of product 42 passes, the cross wall thereby serving to stabilize the product within the container.

The lower end 79 of the main portion of liner 18, i.e., the lower ends of sections 63–66, extends downwardly beyond the bottom edge of shell 16. Liner 18 is so sized that it fits snugly around the portion of insert 15 projecting above top wall 21 of base 14 (see FIG. 4). This frictional engagement maintains the cover 13 and bottom part 12 of the container together until they are manually separated. Also, the bottom edge of liner 18 engaging top wall 21 limits the downward movement of cover 13 with respect to bottom part 12 thereby maintaining a spacing between top wall 21 of base 14 and bottom wall 54 of shell 16.

The components of the container may be made in a variety of colors and may carry any type of printed decoration desired. One effective combination is making insert 15 and liner 18 in the same color which contrasts with the color of the other three components. As a result, top wall 69 and lower end 79 contrast with the shell 16, and the portion of insert 15 projecting above top wall 21 contrasts with base 14.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A merchandise container, comprising:

(a) a box-like base formed of a single piece of paperboard, the top wall of said base having an opening, (b) a box-like insert, formed of a single piece of paperboard, within the opening in said base top wall, said insert projecting above said base top wall and having dimensions in a horizontal plane smaller than the corresponding dimensions of said base, so that said base and insert together have a stepped configuration, and said insert having an opening in its top wall for accommodating an article of merchandise, (c) a double walled shell formed of a single piece of paperboard, at least one end of said shell being open, and (d) a liner, formed of a single piece of paperboard, within said shell, said liner projecting downwardly beneath the bottom edge of said shell and sized and shaped to fit snugly around the portion of said insert projecting above said base.

2. A merchandise container as defined in claim 1 including a core, formed of a single piece of paperboard, between all the double walls of said shell.

3. A merchandise container as defined in claim 2 wherein said core is bent along parallel lines to define separate sections of the core which meet at corners, each section being between one of the double walls of said shell, and at least one tab cut from each section and extending to a corner between that section and an adjacent section, each tab being not folded so that it projects beyond its respective section in the plane of the adjacent section and serves to space apart the two walls of the double shell wall between which its respective section is located.

4. A merchandise container as defined in claim 1 including a platform within said insert parallel to its top wall for supporting merchandise within the opening in the top wall of the insert, said platform being formed of the same piece of paperboard as the remainder of said insert, and being spaced above the bottom of said insert.

5. A merchandise container as defined in claim 1 including locking means, formed of the same piece of paperboard as the remainder of said insert, at each end of said insert for preventing removal of said insert from said base.

6. A merchandise container as defined in claim 5 wherein each locking means includes a flap meeting the insert top wall at a fold line, and an ear folded upwardly along the lower edge of said flap, the free upper edge of said ear engaging the inner face of the base top wall to prevent removal of said insert from said base.

7. A merchandise container as defined in claim 1 wherein both ends of said shell are open, and said liner has a top wall closing the upper end of said shell, said top wall being formed of the same piece of material as the remainder of said liner.

8. A merchandise container as defined in claim 1 wherein said liner has a cross wall between its ends formed of the same piece of material as the remainder of said liner, said cross wall having an opening for accommodating an article of merchandise seated in the insert for stabilizing the merchandise within the closed container.

* * * * *